United States Patent [19]

La Sorte

[11] Patent Number: 4,899,665

[45] Date of Patent: Feb. 13, 1990

[54] ASSEMBLY COMPRISING BOTH A VEHICLE MOVABLE ON RAILS AND SUPPORTING MEANS FOR THE VEHICLE COMPRISING THE RAILS

[76] Inventor: Onofrio La Sorte, Via Gian Carlo Sismondi 50/3, Milan, Italy

[21] Appl. No.: 182,981

[22] Filed: Apr. 18, 1988

[30] Foreign Application Priority Data

Apr. 23, 1987 [IT] Italy ..... 20220 A/87

[51] Int. Cl.[4] ..... B61D 15/00

[52] U.S. Cl. ..... 104/23.1; 105/74

[58] Field of Search ..... 104/89, 91, 94, 95, 104/124, 23.1; 105/1.1–1.3, 74

[56] References Cited

U.S. PATENT DOCUMENTS

| | | | |
|---|---|---|---|
| 1,422,394 | 7/1922 | Wagner | 105/1.3 X |
| 1,437,183 | 11/1922 | Johnson | 105/1.3 X |
| 1,723,352 | 8/1929 | Hohberger | 105/1.3 X |
| 1,840,683 | 1/1932 | Vance | 105/1.3 X |
| 2,788,749 | 4/1957 | Hinsken et al. | 104/89 X |
| 3,233,556 | 2/1966 | McDonald | 104/89 X |
| 3,243,192 | 3/1966 | Franzel | 105/1.3 X |
| 3,626,857 | 12/1971 | Omar | 104/89 X |
| 3,728,974 | 3/1973 | Lashley | 105/340 X |
| 3,730,103 | 5/1973 | Weaver | 105/1.3 X |
| 4,102,548 | 7/1978 | Kangas | 105/1.2 X |
| 4,233,908 | 11/1980 | Omar | 104/89 X |
| 4,771,944 | 9/1988 | Brister et al. | 238/283 |

*Primary Examiner*—Margaret A. Focarino
*Assistant Examiner*—Joseph D. Pape
*Attorney, Agent, or Firm*—Steinberg & Raskin

[57] ABSTRACT

Assembly comprising a vehicle movable on rails and a support for the vehicle, wherein at least the lower part of the vehicle is situated under the geometric tangent plane below the wheels. The support is shaped in such a way to provide an empty space suitable for housing the lower part of the vehicle which is located under the geometric plane.

9 Claims, 3 Drawing Sheets

ASSEMBLY COMPRISING BOTH A VEHICLE MOVABLE ON RAILS AND SUPPORTING MEANS FOR THE VEHICLE COMPRISING THE RAILS

BACKGROUND OF THE INVENTION

This invention concerns a group of elements that comprises both a vehicle movable on rails and supporting means comprising said rails.

As an example, a train that travels on normal rails can be considered. The position of the centre of the gravity depends upon the size of the train and upon other factors and may be at any height, but always above the wheels.

If, in particular, a 'double-decker' train is considered, that is a train comprising both an upper deck and a lower deck, each one suitable for accommodating people and/or goods (or similar), the centre of gravity will be located fairly high with respect to the rails on which the train travels. Therefore in such cases, so as not to risk the stability of the train, its speed cannot exceed a certain limit.

SUMMARY OF THE INVENTION

The basic aim of this invention is to provide means that allow a vehicle, and in particular a train, to travel on rails at a considerably higher speed, in any case at a higher speed than is possible now.

According to this invention this aim has been reached with an assembly of means which comprises a vehicle, movable on rails and means for supporting said rails. The assembly according to this invention is characterized, essentially, in that at least one part comprising the lower surface of the vehicle is located under the geometric tangent plane below the wheels of the vehicle when said plane is horizontal, means being provided to support the rails so that an empty space is created under the rails sufficient to accommodate said part of the vehicle that is located below said geometric plane.

BRIEF DESCRIPTION OF THE DRAWINGS

In order to better show the characteristics of the assembly according to this invention and the advantages that derive from it, exemplary embodiments have been described hereafter with reference to the schematic drawings attached, wherein.

DESCRIPTION OF THE PREFERRED EMBODIMENTS

Figure 1:
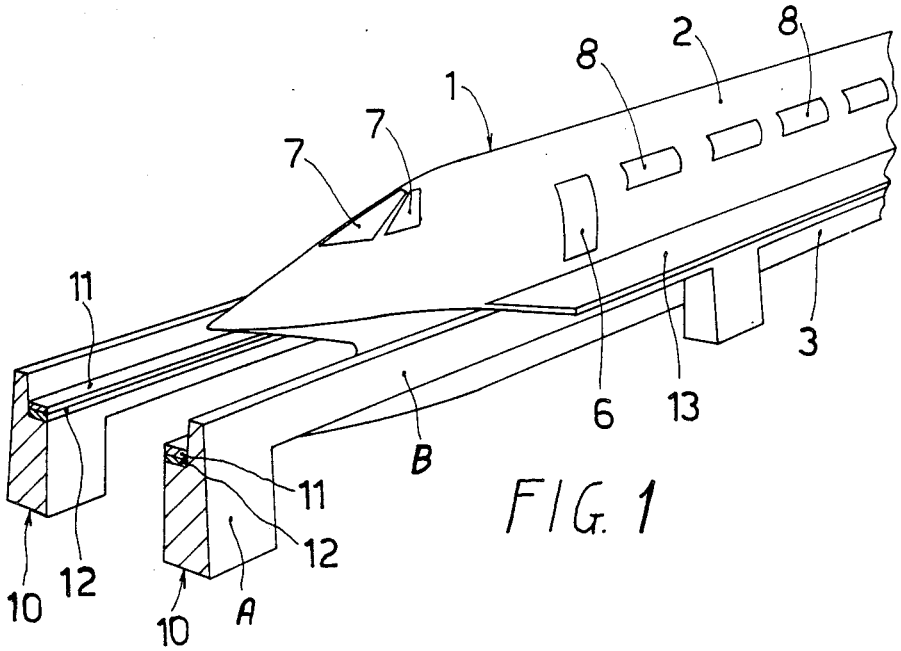
FIG. 1 shows a perspective view, partially in section, of an assembly consisting of a train and supporting means comprising the rails on which said train travels.
Figure 2:
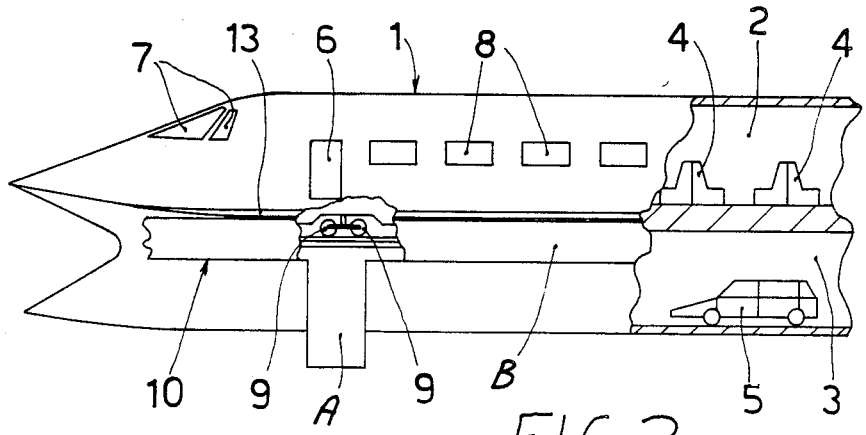
FIG. 2 shows a lateral view, partially in section, of the assembly.

The assembly represented particularly in FIGS. 1–5 comprises a train designated as a whole, with 1. The train 1 is "double-decker", that is it comprises two decks that hereafter will respectively be called, "upper deck" and "lower deck". In this example, the upper deck 2 is designed to house passengers, while the lower deck 3, is designed to house motor vehicles and/or various goods or similar (for example, also animals). In the section of FIG. 2 seats 4 for passengers can be seen on the inside of the upper deck 2, while inside the lower deck 3 a car 5 can be seen. Furthermore in the upper deck 2 there is a door 6, front windows 7 and the side windows 8. The train wheels are indicated with 9. Supporting means are provided comprising two elements both of which are marked with 10 in the assembly. The element 10 is made of steel or reinforced concrete or other suitable material. Each element 10 comprises parts A (in short, pillars) and a horizontal part B (in short, a girder). Sleepers 16 can be provided (as in FIGS. 3 and 4) that connect parts A. Two rails 11 are respectively fixed to the two elements 10 and the wheels of the train rest on these rails. Between each rail 11 and the underlying surface of the supporting element 10 a shock absorber means is provided in position 12 that can be of any suitable kind, to greatly reduce the noise.

Figure 3:
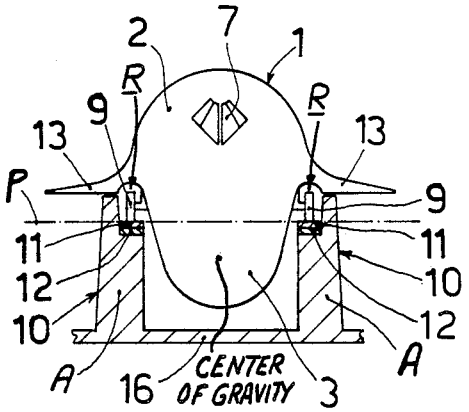
FIG. 3 shows a partial vertical cross-section of the assembly in FIGS. 1 and 2 with a front view of the train (which travels along a straight line)
Figure 4:
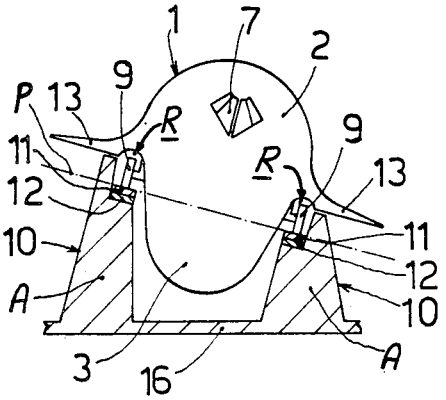
FIG. 4 shows another view also partially in section, as in FIG. 3, but along another vertical plane (while the train travels along curved rails)
Figure 5:
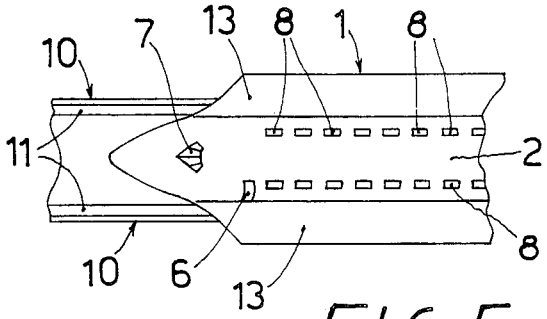
FIG. 5 shows a part of the assembly in plan view, from above.
Figure 6:
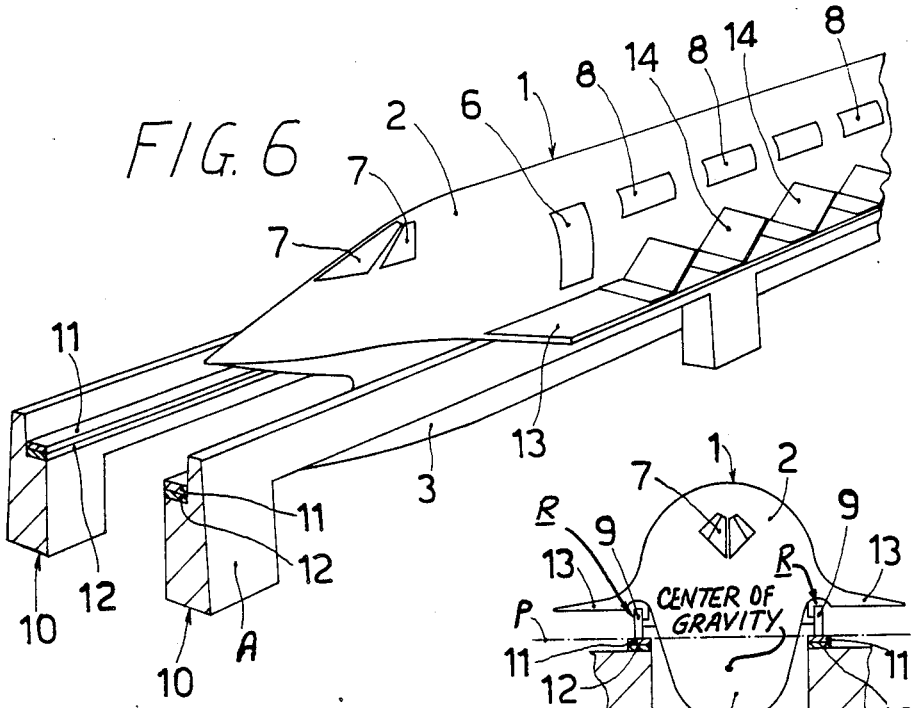
FIG. 6 shows a perspective view, partially in section, of an assembly similar to the one in FIGS. 1–5, but with a variant consisting of ailerons.
Figure 8:
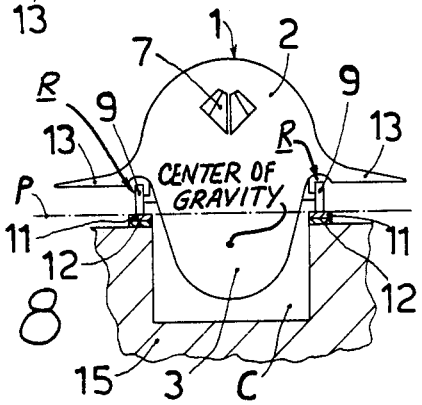
FIG. 8 shows another variant of the assembly, in a view, partially in section, taken along a vertical plane.
Figure 7:
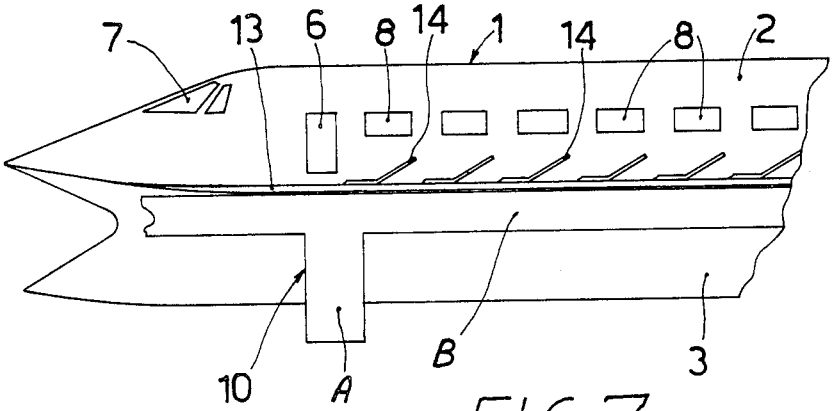
FIG. 7 shows a lateral view, partially in section, of the assembly in FIG. 6.

The train 1 comprises, furthermore, two lateral flyers both marked with 13. As illustrated in FIGS. 3, 4, and 8, the fliers 13 are each provided with a recess R for the respective wheels 9. The assembly in FIGS. 6 and 7 is similar to the one illustrated in FIGS. 1 to 5 and therefore the same parts are identified with the same reference numbers. The assembly represented in FIGS. 6 and 7 comprises, however, a variant made by a series of ailerons 14, hinged to the flyers 13. For example, they can be streamlined ailerons operated by a computerized system. In FIGS. 6 and 7 one flyer 13 is seen with the respective set of ailerons 14 but clearly the other flyer 13 may also have similar ailerons. The ailerons 14 are used to ensure a maximum stability of the train when it travels at high speeds. The portion of the ailerons 14 (that is the angle between the aileron 14 and the plane of the flyer 13) may vary. Systems (in particular electronic systems) may be provided to automatically change the inclined position of the ailerons 14 depending on the speed of the train. Due to the fact that the train, apart from travelling on straight rails, may also run along curved rails, means can also be provided for automatically changing the position of said ailerons depending on the bending radius of the rails. In the variant of FIG. 8 elements 10 are not provided but means 15 providing a recess C, in which the lower deck 3 of the train is located.

In this case the wheels 9 also run on the rails 11 and the shock absorbers are provided between these and the means 15. As mentioned above, the upper deck 2 is preferably the part that houses the passengers (and therefore has appropriate fittings), while the lower deck 3 can accommodate motor vehicles, various goods and products and even animals; clearly, however, the functions of the decks can be reversed.

The train 1, that travels on rails 11, (in all the examples described above) can reach increased speeds. In the curved sections of the track covered, the supporting means 10 can have the configuration shown in FIG. 4. The above-mentioned assembly, comprising the double-decker train and relative supporting system, is considerably advantageous. In fact, if a double-decker train travels on normal rails, with the whole train above these rails, it is evident that the centre of gravity of the moving part is located at a considerable height with respect to the bearing surface (i.e. the surface of the rails). Therefore, to let the train travel with good stability (in particularly on the curves) the speed of the train cannot exceed certain limits. In the assembly described above and illustrated in the attached drawing, the conditions, instead, are extremely different. One part of the train, in fact, is constantly located under the plane of the rails.

In particular in FIGS. 3, 4 and 8 of the attached drawings the (ideal) plane of the rails 11 tangent to the train wheels 9 is marked with P. One part of the train is exactly located below plane P. Calculating the various factors that determine the position of the centre of gravity, in particular, the size of the parts of the train and the distribution of the mass, it is possible for the centre of gravity of the train to be located below said plane P. Trains in which the centre of gravity is above plane P or on the same plane can be provided or else, as abovesaid, under it. For such reasons the train can travel at increased speeds, much higher than in the case of a double-decker train that is entirely above the plane of the rails. Even travelling at increased speeds, the train being a part of the assembly according to this inventions is in any case in condition of excellent stability. In the example described above, a case of a double-decker train is described, but the similar concepts can also be used for normal trains. Similarly, with the same characteristics described above, other vehicles can also be carried out, for example trams and similar, and also toys and free-time games. Numerous advantages are possible, still remaining in the field of this invention.

What is claimed is:

1. An assembly, comprising a vehicle adapted to move on rails, rails mounted to support said vehicle movably thereon, wheels for movably mounting said vehicle on said rails, said vehicle comprising a pair of lateral flyers, and being internally divided into two decks, an upper deck for accommodating loads such as passengers, and a lower deck for accommodating heavy loads such as cargo, a floor of said upper deck being substantially at a level of said flyers, means for supporting said rails and providing an empty area between and below said rails, said lower deck of said vehicle and a center of gravity of the vehicle being located below a tangent plane passing under said vehicle wheels when said vehicle is substantially level upon said rails, wherein said flyers each longitudinally extend along said vehicle, said wheels are situated directly underneath each said flyer, and each said flyer comprises a recess on a lower surface thereof for accommodating said wheels.

2. The combination of claim 1, wherein said vehicle additionally comprises ailerons adjustably mounted upon said flyers.

3. The combination of claim 2, additionally comprising means for automatically adjusting aileron position depending upon vehicle speed.

4. The combination of claim 3, wherein said adjusting means also adjust the aileron position depending upon bending radius of said rails.

5. The combination of claim 1, wherein said vehicle is a train.

6. The combination of claim 1, wherein said supporting means comprises two elements substantially parallel and distanced from one another to define said empty area therebetween.

7. The combination of claim 6, wherein said supporting means additionally comprise sleepers interconnecting said two elements below said space.

8. The combination of claim 7, wherein each said element comprises substantially vertical portions and a substantially horizontal portion supporting said respective rail.

9. The combination of claim 1, wherein said vehicle additionally comprises doors to said upper deck opening just above said flyers.

* * * * *